US006426170B1

(12) United States Patent
Bayley et al.

(10) Patent No.: US 6,426,170 B1
(45) Date of Patent: Jul. 30, 2002

(54) TONER AND DEVELOPER COMPOSITIONS WITH CHARGE ENHANCING ADDITIVES

(75) Inventors: Robert D. Bayley, Fairport; Angelo J. Barbetta, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/850,256

(22) Filed: May 7, 2001

(51) Int. Cl.[7] ..... G03G 9/00
(52) U.S. Cl. ..... 430/108.4; 430/126; 399/297
(58) Field of Search ..... 430/108.1, 108.4, 430/126; 399/297

(56) References Cited

U.S. PATENT DOCUMENTS

| | | | | |
|---|---|---|---|---|
| 2,986,521 | A | 5/1961 | Wielicki | 252/62.1 |
| 3,893,935 | A | 7/1975 | Jadwin et al. | 252/62.1 |
| 4,079,014 | A | 3/1978 | Burness et al. | 252/62.1 P |
| 4,221,856 | A | 9/1980 | Lu | 430/110 |
| 4,291,111 | A | 9/1981 | Lu | 430/107 |
| 4,291,112 | A | 9/1981 | Lu | 430/110 |
| 4,298,672 | A | 11/1981 | Lu | 430/108 |
| 4,312,933 | A | 1/1982 | Lu | 430/122 |
| 4,323,634 | A | 4/1982 | Jadwin | 430/110 |
| 4,326,019 | A | 4/1982 | Lu et al. | 430/108 |
| 4,338,390 | A | 7/1982 | Lu | 430/106 |
| 4,394,430 | A | 7/1983 | Jadwin et al. | 430/110 |
| 4,560,635 | A | 12/1985 | Hoffend et al. | 430/106.6 |
| 4,604,338 | A | 8/1986 | Gruber et al. | 430/106 |
| 4,684,596 | A | 8/1987 | Bonser et al. | 430/110 |
| 4,752,550 | A | 6/1988 | Barbetta et al. | 430/106.6 |
| 4,812,381 | A | 3/1989 | Bugner et al. | 430/110 |
| 4,826,749 | A | 5/1989 | Kawagishi et al. | 430/110 |
| 4,834,921 | A | 5/1989 | Eugner et al. | 260/501.15 |
| 4,904,762 | A | 2/1990 | Chang et al. | 430/110 |
| 5,227,460 | A | 7/1993 | Mahabadi et al. | 528/272 |
| 5,352,556 | A | 10/1994 | Mahabadi et al. | 430/109 |
| 5,376,494 | A | 12/1994 | Mahabadi et al. | 430/137 |
| 5,395,723 | A | 3/1995 | Mahabadi et al. | 430/109 |
| 5,401,602 | A | 3/1995 | Mahabadi et al. | 430/137 |
| 6,214,507 | B1 * | 4/2001 | Sokol et al. | 430/110 |
| 6,306,930 | B1 * | 10/2001 | Tsujio | 523/161 |

* cited by examiner

*Primary Examiner*—John Goodrow
(74) *Attorney, Agent, or Firm*—E. O. Palazzo

(57) ABSTRACT

A toner containing resin, colorant, and a potassium sorbate, or a potassium tartrate charge enhancing additive.

32 Claims, No Drawings

TONER AND DEVELOPER COMPOSITIONS WITH CHARGE ENHANCING ADDITIVES

COPENDING APPLICATION

Illustrated in copending application U.S. Ser. No. 09/850,075; the disclosure of which is totally incorporated herein by reference, and filed concurrently herewith, is a toner composition comprised of resin, colorant, and a potassium stearate charge enhancing additive.

BACKGROUND OF THE INVENTION

The present invention is generally directed to toner and developer compositions, and more specifically, the present invention is directed to developer and toner compositions containing charge enhancing additives, which impart or assist in imparting a negative charge to the toner resin particles and enable toners with rapid admix characteristics. In embodiments, there are provided in accordance with the present invention toner compositions comprised of resin particles, colorant particles, and a charge additive of potassium sorbate, potassium tartrate, potassium stearate, or mixtures thereof.

The aforementioned additives in embodiments of the present invention enable, for example, toners with rapid admix of less than or equal to about 15 seconds, high triboelectric charging values, such as for example, from about 35 to about 60, and more specifically, from about 40 to about 50 microcoulombs per gram as measured by the know charge spectrograph, or by the known Faraday Cage method, extended developer life, stable electrical properties, high image print quality with substantially no background deposits, and compatibility with fuser rolls including VITON™ fuser rolls. The toner compositions of the present invention usually contain colorant particles comprised of, for example, carbon black, magnetites, or mixtures thereof; dyes, mixtures thereof, and the like, such as cyan, magenta, yellow, blue, green, red, brown, black components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles, exceeding, for example, about 1,000,000 in a number of embodiments. The toner and developer compositions of the present invention can be selected for electrophotographic, including xerographic, imaging and printing processes, including color processes, and more specifically, for DAD, discharge area development, CAD, charge area development, HSD, hybrid scavengeless development, HJD, hybrid jumping development, MAZE, magnetic agitated zone development, IMB, inductive magnetic brush development, CMB, conductive magnetic brush development, and the like.

PRIOR ART

Developer compositions with charge enhancing additives, which, for example, impart a positive charge to the toner resin, are known. Thus, for example, there is illustrated in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are illustrated in U.S. Pat. No. 4,338,390, the disclosure which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and colorant particles, and as charge enhancing additives alkyl pyridinium compounds. Additionally, other patents disclosing toner compositions with charge control additives include U.S. Pat. Nos. 3,944,493; 4,007,293; 4,079,014; 4,394,430, and 4,560,635.

The following United States patents were listed in a search report: U.S. Pat. No. 4,812,381, which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; a similar teaching is presented in U.S. Pat. Nos. 4,834,921; 4,490,455 which discloses toners with, for example, amine salt charge enhancing additives, reference the Abstract of the Disclosure, for example, and wherein A is an anion including those derived from aromatic substituted sulfonic acids, such as benzene sulfonic acid, and the like, see column 3, beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; Reissue 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634, which discloses toners with charge additives of the formulas presented in column 3, wherein providing that at least one of the Rs is a long chain amido group, and X is a halide ion or an organosulfur containing group; U.S. Pat. No. 4,326,019 relating to toners with long chain hydrazinium compounds wherein the anion A can be a sulfate, sulfonate, phosphate, halides, nitrate, see the Abstract of the Disclosure, for example; U.S. Pat. No.

4,752,550 which illustrates toners with inner salt charge additives, or mixtures of charge additives, see for example column 8; U.S. Pat. No. 4,684,596, which discloses toners with charge additives of the formula provided in column 3 wherein X can be variety of anions such as trifluoromethane sulfonate, and U.S. Pat. Nos. 4,604,338; 4,792,513; 3,893,935; 4,826,749, and U.S. Pat. No. 4,604,338, the disclosure of each of the aforementioned patents being totally incorporated herein by reference.

Also mentioned are U.S. Pat. No. 4,752,550, the disclosure of which is totally incorporated herein by reference, directed to toners and developers with inner salt charge additives and mixtures of such salts with other charge additives, see for example column 4; and Reissue 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, colorant particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a toner for the development of electrostatic images, and which toner contains a metal complex represented by the formula in column 2, for example, and wherein ME can be chromium, cobalt or iron. Additionally, patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Further, in U.S. Pat. No. 4,433,040, the disclosure of which is totally incorporated herein by reference, there are illustrated toner compositions with chromium and cobalt complexes of azo dyes as negative charge enhancing additives.

Illustrated in U.S. Pat. No. 4,937,157, the disclosure of which is totally incorporated herein by reference, are toner compositions comprised of resin, colorant, or dye, and tetraalkyl, wherein alkyl, for example, contains from 1 to about 30 carbon atoms, ammonium bisulfate charge enhancing additives, such as distearyl dimethyl ammonium bisulfate, tetramethyl ammonium bisulfate, tetraethyl ammonium bisulfate, tetrabutyl ammonium bisulfate, dimethyl dialkyl ammonium bisulfate compounds, where the dialkyl radicals contain from about 10 to about 30 carbon atoms, and more specifically, dialkyl groups with from about 14 to about 22 carbon atoms, and the like.

Although a number of toner charge enhancing additives are known, there continues to be a need for toners with charge additives and which toners possess many of the advantages illustrated herein. Additionally, there is a need for positive and negative charge enhancing additives which are useful for incorporation into black, and/or colored toner compositions. There is also a need for toner compositions with certain charge enhancing additives, which toners in embodiments thereof possess acceptable substantially stable triboelectric charging characteristics, and excellent admixing properties. Moreover, there continues to be a need for negatively charged toner and developer compositions. Further, there is a need for toners with certain charge enhancing additives which can be easily and permanently dispersed into toner resin particles. There also is a need for negatively charged black, and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for toner compositions which possess the desired high triboelectric charge level, for example from about 40 to about 65 microcoulombs per gram, and more specifically, from about 40 to about 50 microcoulombs per gram, and admix charging rates of from about 5 to about 60 seconds, and more specifically, from about 15 to about 30 seconds, as determined by the charge spectrograph at, for example, low concentrations, that is, for example, less than about 1 percent, and more specifically, about 0.5 percent of the charge enhancing additive of the present invention.

SUMMARY OF THE INVENTION

It is a feature of the present invention to provide toner and developer compositions with charge enhancing additives.

In another feature of the present invention there are provided positively charged toner compositions useful for the development of electrostatic latent images including color images.

In yet another feature of the present invention there are provided positively charged toner compositions containing certain enhancing additives.

In yet another feature of the present invention there are provided negatively charged toner compositions.

Another feature of the present invention resides in providing toner compositions with mixtures of charge enhancing additives.

Also, in another feature of the present invention there are provided developer compositions with negatively charged toner particles, carrier particles, and the enhancing additives illustrated herein, or mixtures of these additives with other known charge enhancing additives.

In yet a further feature of the present invention there are provided humidity insensitive, from about, for example, 20 to 80 percent relative humidity at temperatures of from about 60 to about 80° F. as determined in a relative humidity testing chamber, negatively charged toner compositions with desirable admix properties of about 5 seconds to about 60 seconds as determined by the charge spectrograph, and more specifically, less than 15 seconds, for example, and yet more specifically, from about 1 to about 14 seconds, and acceptable high triboelectric charging values of from about 40 to about 60 microcoulombs per gram.

Additionally, in a further feature of the present invention there are provided negatively charged magnetic toner compositions, and negatively charged colored toner compositions containing therein, or thereon certain charge enhancing additives Furthermore, in yet another feature of the present invention there are provided toner and developer compositions with charge enhancing additives, which compositions are useful in a variety of electrostatic imaging and printing processes, including color, and optionally wherein the admix charging times are less than about 60 seconds.

Moreover, in another feature of the present invention that are provided thermally stable charge enhancing additives, that is for example additives which do not decompose at high temperatures of, for example, of from about 130 to about 160° C.

Another feature of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

These and other features of the present invention can be accomplished in embodiments thereof by providing toner compositions comprised of resin particles, colorant particles, and the charge enhancing additives illustrated herein. More specifically, the present invention in embodiments is directed to toner compositions comprised of resin, colorant, or dye, and a charge enhancing additive of potassium sorbate, potassium tartrate, potassium stearate, or mixtures thereof. The aforementioned charge additives can be incorporated into the toner, may be present on the toner surface or may be present on toner surface additives such as colloidal silica particles. Also, the toners of the present invention may contain mixtures of the aforementioned charge additive with other charge additives such as distearyl dimethyl ammonium methylsulfate, the bisulfates, and charge additives of U.S. Pat. Nos. 4,937,157 and 4,904,762, the disclosures of which are totally incorporated herein by reference, the charge additives of the patents mentioned herein; and the like. With mixtures, from about 0.05 to about 1 percent by weight of the charge enhancing additive of the present invention can be selected, and from about 0.05 to about 1 percent of a second charge enhancing additive can be selected in embodiments of the present invention. Other amounts of mixtures may also be selected in embodiments of the present invention.

Aspects of the present invention relate to a toner composition comprised of resin, colorant, and a potassium sorbate, or a potassium tartrate charge enhancing additive; a toner composition comprised of resin particles, colorant particles, and a potassium sorbate, a potassium tartrate, or mixtures thereof, charge additive; a toner composition wherein the charge additive is potassium sorbate; a toner composition wherein the charge additive is potassium tartrate or potassium stearate; a toner wherein the charge additive mixture is comprised of from about 1 to about 99 weight percent of potassium sorbate and from about 1 to about 99 weight percent of potassium tartrate, and wherein the total thereof is about 100 weight percent or parts; a toner composition further containing a charge enhancing selected form the group consisting of distearyl methyl hydrogen ammonium bisulfate, didodecyl methyl ammonium hydrogen bisulfate, dihexadecyl methyl ammonium hydrogen bisulfate, distearyl ethyl ammonium hydrogen bisulfate, bis-(distearyl methyl hydrogen ammonium) sulfate and mixtures thereof in an amount of, for example, from about 0.05 to about 3 weight percent; a toner composition further containing a second charge enhancing additive selected form the group consisting of distearyl dimethyl ammonium methyl sulfonate, distearyl dimethyl ammonium trifluoromethyl sulfonate, didodecyl dimethyl ammonium hydrogen methyl sulfonate, dihexadecyl methyl ammonium hydrogen methyl sulfonate, didodecyl trifluoromethyl ammonium hydrogen methyl sulfonate, dihexadecyl methyl ammonium hydrogen trifluoromethyl sulfonate, distearyl diethyl ammonium ethyl sulfonate, trifluoromethyl ammonium hydrogen methyl sulfonate, and other known toner charge additives; a toner composition wherein the charge additive is present in an amount of from about 0.05 to about 5 weight percent; a toner composition wherein the charge additive is present in an amount of from about 0.1 to about 3 weight percent; a toner composition wherein the charge additive is incorporated into the toner; a toner composition wherein the charge additive is present on the surface of the toner composition; a toner composition wherein the charge additive is contained on colloidal silica particles; a toner composition with an admix time of from less than about, or equal to about 15 seconds; a toner composition with an admix time of from about 1 to about 14 seconds; a toner composition with a triboelectric charge of from about 40 to about 60 microcoulombs per gram; a toner composition wherein a colloidal silica is mixed with the charge enhancing additive, and the resulting composition is present on the surface of the toner; a toner composition wherein the resin particles are comprised of styrene polymers, polyesters, or mixtures thereof; a toner composition containing a wax component with, for example, a weight average molecular weight of from about 1,000 to about 10,000; a toner containing a wax component selected from the group consisting of polyethylene, polypropylene or mixtures thereof; a toner composition containing as external additives metal salts of a fatty acid, colloidal silicas, or mixtures thereof; a toner composition wherein the colorant is carbon black, magnetite, or mixtures thereof, cyan, magenta, yellow, red, blue, green, black, brown, or mixtures thereof; a toner wherein the charge additive is present in an amount of from about 0.05 to about 3 weight percent; a developer composition comprised of the toner illustrated herein and carrier particles; a developer composition wherein the carrier particles are comprised of ferrites, steel, or an iron powder; a developer composition wherein the carrier particles are comprised of a core with a polymer coating thereover; a developer composition wherein the carrier coating is comprised of a methyl terpolymer, a polyvinylidene fluoride, a polymethyl methacrylate, or a mixture of polymers not in close proximity in the triboelectric series; a method of imaging which comprises formulating an electrostatic latent image on a photoreceptor, affecting development thereof with the toner composition illustrated herein, and thereafter transferring the developed image to a suitable substrate; a method of imaging wherein the transferred image is permanently fixed to the substrate; a single component toner composition comprised of resin particles, magnetite components, and potassium sorbate, potassium tartrate, or potassium stearate; a toner comprised of binder, colorant, and potassium sorbate; a toner comprised of binder, colorant, and potassium tartrate; a toner composition comprised of resin, colorant and a potassium stearate charge enhancing additive; a toner comprised of resin particles, colorant particles, and a potassium stearate charge additive; and a toner composition comprised of resin, colorant and potassium stearate.

The toner compositions of the present invention can be prepared by a number of methods such as admixing and heating resin particles such as styrene butadiene copolymers, colorant particles such as magnetite, carbon black, dyes, or mixtures thereof, and, for example, from about 0.5 percent to about 5 percent of the aforementioned charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of, for example, less than about 25 microns, and more specifically, of from about 8 to about 12 microns, which diameters are determined by a Coulter Counter. Subsequently, the toner compositions can be classified utilizing, for example, a Donaldson Model B classifier for the purpose of removing fines, that is toner particles of, for example, less than about 4 microns volume median diameter.

Illustrative examples of suitable toner resins selected for the toner and developer compositions of the present invention include, for example, thermoplastics; polyamides, polyolefins, styrene acrylates, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent. In addition, crosslinked resins, including polymers, copolymers, and/or homopolymers of the aforementioned styrene polymers may be selected.

As toner resins, there can be selected the esterification products of a dicarboxylic acid and a diol comprising a diphenol. These resins are illustrated, for example, in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof; extruded polyesters, reference U.S. Pat. No. 6,139,674, the disclosure of which is totally incorporated herein by reference. Also, waxes with a weight average molecular weight, $M_w$, of, for example, from about 1,000 to about 10,000 such as polyethylene, polypropylene, and paraffin waxes can be included in, or on the toner compositions as, for example, fuser roll release agents.

The resin particles are present in a sufficient, but effective amount, for example from about 70 to about 90 weight percent. Thus, when 1 percent by weight of the charge enhancing additive is present, and 10 percent by weight of colorant, such as carbon black, is contained therein, about 89 percent by weight of resin is selected. Also, the charge enhancing additives of the present inventions may be coated on the colorant particles. When used as a coating, the charge enhancing additives of the present invention are present in an amount of from about 0.1 weight percent to about 5 weight percent, and more specifically, from about 0.3 weight percent to about 1 weight percent.

Numerous well known suitable colorants or dyes can be selected, reference for example the appropriate copending applications recited herein, as the colorant for the toner particles including, for example, carbon black, nigrosine dye, aniline blue, magnetite, cyan, magenta, yellow, or mixtures thereof. The colorant, such as carbon black, should be present in a sufficient amount to render the toner composition highly colored. Generally, the colorant particles are present in amounts of from about 1 percent by weight to about 20 percent by weight, and more specifically, from about 2 to about 10 weight percent based on the total weight of the toner component; however, lesser or greater amounts of colorant particles may be selected in embodiments.

The colorant particles may be comprised of magnetites, thereby enabling single component toners in some instances, which magnetites are comprised, for example, of a mixture of iron oxides ($FeO.Fe_2O_3$) including those commercially available as MAPICO BLACK™, and which can be present in the toner composition in various amounts, such as an amount of from about 10 percent by weight to about 70 percent by weight, and more specifically, in an amount of from about 10 percent by weight to about 50 percent by weight. Mixtures of black colorants, such as carbon blacks and magnetite with from about 1 to about 15 weight percent of carbon black, and more specifically, from about 2 to about 6 weight percent of carbon black, and magnetite, such as MAPICO BLACK™, in an amount of, for example, from about 5 to about 60, and more specifically, from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, coated silicas, and mixtures thereof, which additives are generally present in an amount of from about 0.1 percent by weight to about 5 percent by weight, and preferably in an amount of from about 0.1 percent by weight to about 1 percent by weight. Several of the aforementioned additives and others are illustrated in U.S. Pat. Nos. 3,590,000; 3,800,588 and 6,214,507.

There can be included in the toner compositions of the present invention optional toner additives, such as waxes like polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K. K., and similar materials. The commercially available polyethylenes selected are believed to possess a molecular weight, $M_w$ of from about 1,000 to about 2,500, and the commercially available polypropylene waxes are believed to have a molecular weight, $M_w$ of from about 4,000 to about 5,000. Many of the polyethylene and polypropylene compositions selected for the toners of the present invention are illustrated in British Patent No. 1,442,835, the disclosure of which is totally incorporated herein by reference.

The waxes are present in the toner composition in various amounts, however, generally these waxes are present in the toner composition in an amount of, for example, from about 1 percent by weight to about 15 percent by weight, and more specifically, in an amount of from about 2 percent by weight to about 10 percent by weight.

Encompassed within the scope of the present invention are toner and developer compositions comprised of toner resin particles, optional carrier particles, the charge enhancing additives illustrated herein, and as colorants red, blue, green, brown, magenta, black, cyan and/or yellow particles, and mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be selected as colorants include copper tetra-4-(octadecyl sulfonamido) phthalocyanine, X-copper phthalocyanine colorant listed in the Color Index as CI 74160, CI Colorant Blue, and Anthrathrene Blue, identified in the Color Index as CI 69810, Special Blue X-2137, and the like; while illustrative examples of yellow colorants that may be selected are diarylide yellow 3,3-dichlorobenzidene acetoacetanilides, a monoazo colorant identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, and Permanent Yellow FGL. In embodiments, these colored colorant particles are present in the toner composition in an amount of, for example, from about 2 percent by weight to about 15 percent by weight based on the weight of the toner components. Examples of dyes include food dyes and other known dyes.

For the formulation of developer compositions, there are mixed toner and carrier components, particularly those that are capable of triboelectrically assuming an opposite polarity to that of the toner. Accordingly, the carrier particles can be selected to be of a positive or negative polarity enabling the toner particles, which are negatively charged, to adhere to and surround the carrier particles. Illustrative examples of carrier particles include iron powder, steel, nickel, iron, ferrites, including copper zinc ferrites, strontium ferrite, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of, for example, from about 5 to about 30 percent by weight. Polymer coatings not in close proximity in the triboelectric series can also be selected, reference U.S. Pat. Nos. 4,935,326 and 4,937,166, the disclosures of which are totally incorporated herein by reference, including for example Keener and polymethylmethacrylate mixtures (40/60). Coating weights can vary as indicated herein; generally, however, from about 0.3 to about 2, and more specifically, from about 0.5 to about 1.5 weight percent coating weight is selected.

The diameter of the carrier particles, usually spherical in shape, is generally from about 50 microns to about 1,000 microns, and more specifically, from about 70 to about 300 microns in diameter thereby permitting them to possess sufficient density and inertia to avoid adherence to the electrostatic images during the development process. The carrier component can be mixed with the toner composition in various suitable combinations, such as for example, from about 1 to 5 parts per toner to about 100 parts to about 200 parts by weight of carrier.

The toner and developer compositions of the present invention may be selected for use in electrostatographic imaging apparatuses containing therein conventional photoreceptors providing that they are capable of, for example, being charged negatively. Thus, the toner and developer compositions of the present invention can be used with layered photoreceptors that can be charged negatively, such as those illustrated in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the features of the present invention are achievable.

The following Examples are being provided. Parts and percentages are by weight unless otherwise indicated.

SYNTHETIC EXAMPLE I

Copolymers were prepared without added nonionic surfactant by a process referred to as "soapless" or surfactant free emulsion polymerization ("SFP") at an overall solids content of 15 to 45 weight percent. Specifically, a copolymer of 8 percent by weight of diisopropylaminoethylmethacrylate (DIAEMA) and 92 percent by weight of methyl methacrylate (MMA) was prepared by dissolving 2.4 grams of ammonium persulfate in 1 liter of distilled water in a suitable reaction vessel, and providing mechanical stirring, a nitrogen atmosphere, and a thermostatic control. The temperature was controlled to 75° C. +/−1° C. as the monomer mixture of 8 percent by weight diisopropylaminoethylmethacrylate (DIAEMA) and 92 percent methyl methacrylate (MMA) was metered into the reaction vessel at a rate of 1 to 2 grams/minute.

The polymerization was accomplished by heating the reactor contents between 74° C. to 76° C., and which heating was continued for an additional 1 to 3 hours. The copolymer powder of the resulting emulsion polymerization, which was comprised of 8 percent by weight of diisopropylaminoethylmethacrylate and 92 percent by weight of methyl methacrylate, was isolated by freeze drying techniques. The resulting polymer powder was determined to have a number median particle diameter of 0.1 to 0.90 micron as estimated by the light scattering of a redispersed aqueous suspension of the above freeze dried copolymer product. Molecular weight ($M_w$) of the above copolymer product was 55,000, and the molecular weight distribution ($M_wD$) was 2.5 as determined by gel permeation chromatography.

CARRIER EXAMPLE I (F3C-490)

In the first step of the carrier coating process, 6.81 grams of a copolymer comprised of 92 percent of methylmethacrylate (MMA) and 8 percent of diisopropylaminoethylmethacrylate (DIAEMA), and as prepared in Synthesis Example I, 38.59 grams of a thermosetting crosslinked polyester/polyurethane polymer (Envirocron PCU10101, obtained from PPG Industries) with a particle size of between 4 and 7 microns, and 4,540 grams of 65 micron Hoeganaes core were mixed. The mixing was accomplished in a M5R blender with the following process conditions:

blender speed of 27.5 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 360° F. thereby causing the polymers to melt and fuse to the core. There resulted a uniform and continuous polymer coating on the carrier core. The product from the kiln was screened through an 84 TBC (Tensile Bolt Cloth) mesh screen to remove any large agglomerates. The final product was comprised of a carrier core of the above 65 micron. Hoeganaes with a total of 1 percent coating weight polymer of 15 weight percent of the copolymer of 8 percent by weight diisopropylaminoethylmethacrylate (DIAEMA), 92 percent of methyl methacrylate (MMA) and 85 weight percent of crosslinked polyester/polyurethane on the carrier surface.

CARRIER EXAMPLE II (F3C-348)

In the first step of the carrier coating process, 44.91 grams of 100 percent polymethylmethacrylate (PMMA) with a particle size of about 1.2 microns and 4,491 grams of 65 micron volume Hoeganaes core were mixed. The mixing was accomplished in a M5R blender with the following process conditions: blender speed of 27.5 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This. furnace was maintained at a temperature of 390° F. thereby causing the polymers to melt and fuse to the core. The product from the kiln was screened through an 84 TBC (Tensile Bolt Cloth) mesh screen to remove any large agglomerates. The final product was comprised of the above carrier core with a total of 1 percent coating weight of the polymer polymethylmethacrylate on the surface.

RESIN EXAMPLE I

A toner resin was prepared by the polycondensation reaction of bisphenol A and fumaric acid to form a commercially available linear polyester referred to as Resapol HT as follows. A poly(propoxylated bisphenol A fumarate) polymer was prepared by the following procedure. A 3 liter glass reactor was assembled with a stainless steel helical anchor stirrer and a high vacuum stirrer bearing adapter, glass thermometer well and a 250° C. thermometer, inert gas inlet adapter, water-jacketed vigreux column fixed with a Dean Stark trap and condenser, and a full length heating mantle controlled with an $I_2$ R Thermowatch Regulator attached to the thermometer.

1,613 Grams (4.689 moles) of propoxylated bisphenol A (SYNFAC 8029, lot 1060, obtained from Milliken Chemicals), and 557 grams (4.798 moles) of fumaric acid were then added to the reactor. After the reactor and its contents reached 135° C., the obtained slurry was argon sparged for approximately 20 minutes to remove dissolved oxygen. Heating was allowed to continue to approximately 190° C.

Water from the esterification was removed using the Dean Stark trap/condenser system until 145 grams (about 74 percent of theoretical) of water were removed. At this time, the reactor was connected to the high vacuum trap system with two inline dry ice traps and the reactor contents raised to 200° C. A vacuum was slowly applied and maintained at about 50 microns. After three hours and twenty minutes, the resin was removed from the reactor. Upon analysis the results compared favorably to commercially prepared poly (propoxylated bisphenol A-cofumarate) polymer, having a melt index of about 52 grams per ten minutes at 117° C./2.160 kilograms and a Tg of 55.4° C. as measured on a Perkin Elmer DSC-4. Gel permeation chromatography of the polymer product confirmed an $M_w$ of about 13,400, an $M_n$ of about 6,200 and an $M_wD$ of about 2.16. This polymer synthesis was representative of a commercially prepared poly(propoxylated bisphenol A fumarate) polymer referred to as Resopal HT.

RESIN EXAMPLE II

A second polyester was prepared by selecting the above prepared Resapol HT and adding it to an extruder with a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, the disclosures of each of these patents being totally incorporated herein by reference, and more specifically, the polyester of the '494 patent.

More specifically, a crosslinked unsaturated polyester resin was prepared by reactive extrusion process by melt mixing 98.6 parts of a linear unsaturated polyester with the format and properties described in Resin Example I, and 1.4 parts benzoyl peroxide initiator as follows.

The unsaturated polyester resin and benzoyl peroxide initiator were blended in a rotary tumble blender for 30 minutes. The resulting dry mixture was then fed into a Werner & Pfleiderer ZSK-30 twin screw extruder at 10 pounds per hour using a loss-in-weight feeder. The crosslinking was accomplished in the extruder using the following process conditions: barrel temperature profile of 70/160/160/160/160/160/160° C., die head temperature of 160° C., screw rotational speed of 100 revolutions per minute and average residence time of about three minutes. The extrudate melt, upon exiting from the strand die, was cooled in a water bath and pelletized. The product, which was crosslinked polyester, had an onset Tg of about 54° C. as measured by DSC, melt viscosity of about 65,000 poise at 100° C., and about 12,000 poise at 160° C. as measured at 10 radians per second, a gel content of about 50 weight percent and a mean microgel particle size of about 0.1 micron as determined by transmission electron microscopy.

The gel content of the crosslinked resin was determined by the following procedure. The linear and crosslinked portions of the above resin product were separated by dissolving the product in tetrahydrofuran and filtering off the microgel. The microgel was dried to a uniform weight to determine the total gel content. The dissolved part was reclaimed by evaporating the tetrahydrofuran. This linear part of the resin, when characterized by GPC, was found to have an $M_n$ of about 3,900, an $M_w$ of about 10,100, an $M_w/M_n$ of about 2.59, and onset Tg of 55° C., which was substantially the same as the original noncrosslinked resin, which indicated that it contains no solids.

EXAMPLE III

A Control Toner is Prepared by the Following Procedure

75 Parts by weight of the resin Resapol HT from Resin Example I, 14 parts by weight of the 30 weight percent gel polyester from Resin Example II, and 11 parts by weight of Sun Blue Flush, which is a mixture of 30 weight percent P.B. 15:3 copper phthalocyanine and 70 weight percent Resapol HT prepared at Sun Chemicals by flushing to obtain a high quality pigment dispersion, were blended together and extruded in a ZSK-40 extruder. The extruded blend was jetted and classified to form a cyan toner with about 92 weight percent of the above toner resin and 8 weight percent of the above cyan pigment. The toner diameter was 6.5 microns as measured by a Layson Cell, and the cyan toner had a gel concentration of 5 weight percent.

A developer was prepared by mixing 4 parts of the above prepared toner with 100 parts of a carrier of a Hoeganaes steel core, 65 microns in diameter, coated with 100 weight percent of polymethylmethacrylate, reference Carrier Example II. The resulting developer was acclimated at 50 percent RH in an environmental chamber for 24 hours. After 90 minutes of paint shaking, the toner possessed a Faraday Cage blow off tribo of −15 femtocoulombs per gram.

EXAMPLE IVA 74.5 Parts by weight of the Resapol HT resin from Resin Example I, 14 parts by weight of the 30 weight percent gel polyester from Resin Example II, and 11 parts by weight of Sun Blue Flush comprised of a mixture of 30 weight percent P.B. 15:3 copper phthalocyanine, and 70 weight percent Resapol HT prepared at Sun Chemicals by flushing to obtain a high quality pigment dispersion, and 0.5 percent potassium stearate (obtained from Witco Corporation) were blended together and extruded in a ZSK-40 extruder The extruded blend was jetted and classified to form a cyan toner with 91.5 weight percent of the above resin, about 8 weight percent of 15:3 copper phthalocyanine, and 0.5 percent potassium stearate, and wherein the toner particle size was about 6.5 microns as measured by a Layson Cell. The above cyan toner had a gel concentration of 5 weight percent, which gel was determined as illustrated in U.S. Pat. No. 5,376,494, the disclosure of which is totally incorporated herein by reference.

A developer was prepared by mixing 4 parts of the above prepared toner with 100 parts of a carrier of a 65 micron diameter Hoeganaes steel core coated with 100 weight percent of polymethylmethacrylate. This developer was then acclimated at 50 percent RH in an environmental chamber for 24 hours. After 90 minutes of paint shaking, it was determined that the toner possessed a blow off tribo of −36 femtocoulombs per gram.

EXAMPLE IVB 74.5 Parts by weight of the Resapol HT resin of Example I, 14 parts by weight of the 30 weight percent gel polyester of Example I, and 11 parts by weight of Sun Blue Flush, which is a mixture of 30 weight percent P.B. 15:3 copper phthalocyanine, and 70 weight percent Resapol HT prepared at Sun Chemicals by flushing to obtain a high quality pigment dispersion, and 1 percent potassium stearate (obtained from Witco Corporation) were blended together and extruded in a ZSK-40 extruder. The extruded blend was jetted and classified to form a cyan toner with about 92 percent by weight of the above resin (Resopal HT), and 8 weight percent of 15:3 copper phthalocyanine, and wherein the toner particle size was about 6.5 microns as measured by a Layson Cell. The final cyan toner had a gel concentration of 5 weight percent.

A developer was prepared by mixing 4 parts of the above prepared toner with 100 parts of a carrier of a Hoeganaes steel core coated with 100 weight percent of polymethylmethacrylate. This developer was then acclimated at 50 percent RH in an environmental chamber for 24 hours. After 90 minutes of paint shaking, it was determined that the toner possessed a blow off tribo of −45 femtocoulombs per gram.

EXAMPLE V 74.5 Parts by weight of the Resapol HT resin from Example I, 14 parts by weight of the 30 weight percent gel polyester from Example II, and 11 parts by weight of Sun Blue Flush, comprised of a mixture of 30 weight percent P.B. 15:3 copper phthalocyanine, and 70 weight percent Resapol HT prepared at Sun Chemicals by flushing to obtain a high quality pigment dispersion, and 3 percent potassium stearate (obtained from Witco Corporation) were blended together and extruded in a ZSK-40 extruder. The extruded blend was jetted and classified to form a cyan toner with about 92 percent by weight of the above resin (Resopal HT), 8 weight percent of the above pigment, and wherein the toner particle size is about 6.5 microns as measured by a Layson Cell. The final cyan toner had a gel concentration of 5 weight percent.

A developer was prepared by mixing 4 parts of the above prepared toner with 100 parts of a carrier of a Hoeganaes steel core coated with 100 weight percent of polymethylmethacrylate. This developer was acclimated at 50 percent RH in an environmental chamber for 24 hours. After 90 minutes of paint shaking, the above toner possessed a blow off tribo of −58 femtocoulombs per gram.

EXAMPLE VI 74.5 Parts by weight of the Resapol HT resin from Example I, 14 parts by weight of the 30 weight percent gel polyester from Example II, and 11 parts by weight of Sun Blue Flush, which flush is comprised of a mixture of 30 weight percent P.B. 15:3 copper phthalocyanine, 70 weight percent Resapol HT prepared at Sun Chemicals by flushing to obtain a high quality pigment dispersion, and 0.5 percent potassium sorbate (obtained from TCI America) were blended together and extruded in a ZSK-40 extruder. The extruded blend was jetted and classified to form a cyan toner with about 92 percent by weight of the above resin, 8 weight percent of 15:3 copper phthalocyanine, and 0.5 percent potassium sorbate wherein the toner particle size was about 6.5 microns as measured by a Layson Cell. The final cyan toner had a gel concentration of 5 weight percent.

A developer was prepared by mixing 4 parts of the above prepared toner with 100 parts of a carrier of a 65 micron diameter Hoeganaes steel core coated with 100 weight percent of polymethylmethacrylate. This developer was then acclimated at 50 percent RH in an environmental chamber for 24 hours . After 90 minutes of paint shaking, it was determined that the toner possessed a blow off tribo of −49 femtocoulombs per gram.

EXAMPLE VII 74.5 Parts by weight of the Resapol HT resin from Example I, 14 parts by weight of the 30 weight percent gel polyester from Example II, and 11 parts by weight of Sun Blue Flush, comprised of a mixture of 30 weight percent P.B. 15:3 copper phthalocyanine, 70 weight percent Resapol HT prepared at Sun Chemicals by flushing to obtain a high quality pigment dispersion, and 1 percent potassium sorbate (obtained from TCI America) were blended together and extruded in a ZSK-40 extruder. The extruded blend was jetted and classified to form a cyan toner with 92 percent by weight of the above resin (Resopal HT), about 8 weight percent of 15:3 copper was about 6.5 microns as measured by a Layson Cell, and about 1 percent of the charge additive potassium sorbate. The final cyan toner had a gel concentration of 5 weight percent.

A developer was prepared by mixing 4 parts of the above prepared toner with 100 parts of a carrier of a (65 microns) Hoeganaes steel core coated with 100 weight percent of polymethylmethacrylate. The developer was then acclimated at 50 percent RH in an environmental chamber for 24 hours . After 90 minutes of paint shaking, it was determined that the toner possessed a blowoff tribo of −49 femtocoulombs per gram.

EXAMPLE VIII 74.5 Parts by weight of the Resapol HT resin from Example I, 14 parts by weight of the 30 weight percent gel polyester from Example II, and 11 parts by weight of Sun Blue Flush, comprised of a mixture of 30 weight percent P.B. 15:3 copper phthalocyanine, and 70 weight percent Resapol HT prepared at Sun Chemicals by flushing to obtain a high quality pigment dispersion, and 3 percent potassium sorbate (obtained from TCI America) were blended together and extruded in a ZSK-40 extruder. The extruded blend was jetted and classified to form a cyan toner with about 92 percent by weight of the above resin composition polymer, about 8 weight percent of 15:3 copper phthalocyanine, and 3 weight percent of potassium sorbate with a toner particle size of about 6.5 microns as measured by a Layson Cell. The final cyan toner had a gel concentration of 7 weight percent.

A developer was prepared by mixing 4 parts of the above prepared toner with 100 parts of a carrier of a Hoeganaes steel core coated with 100 weight percent of polymethylmethacrylate. The developer was acclimated at 50 percent RH in an environmental chamber for 24 hours . After 90 minutes of paint shaking, it was determined that the toner possessed a blow off tribo of −67 femtocoulombs per gram.

EXAMPLE IX 74.5 Parts by weight of the Resapol HT resin from Example I, 14 parts by weight of the 30 weight percent gel polyester of Example II, and 11 parts by weight of Sun Blue Flush, comprised of a mixture of 30 weight percent P.B. 15:3 copper phthalocyanine, and 70 weight percent Resapol HT prepared at Sun Chemicals by flushing to obtain a high quality pigment dispersion, and 0.5 percent potassium tartrate (from Lancaster Chemical) were blended together and extruded in a ZSK-40 extruder. The extruded blend was jetted and classified to form a cyan toner with about 92 percent by weight of the above resin composition, about 7.5 weight percent of 15:3 copper phthalocyanine, and 0.5 percent potassium tartrate, and wherein the toner particle size was about 6.5 microns as measured by a Layson Cell. The final cyan toner had a gel concentration of about 7 weight percent.

A developer was prepared by mixing 4 parts of the above prepared toner with 100 parts of a carrier of a Hoeganaes steel core coated with 100 weight percent of polymethylmethacrylate. The developer was acclimated at 50 percent RH in an environmental chamber for 24 hours . After 90 minutes of paint shaking, the toner possessed a blow off tribo of −36 femtocoulombs per gram.

EXAMPLE X 74.5 Parts by weight of the Resapol HT resin of Example I, 14 parts by weight of the 30 weight percent gel polyester of Example II, and 11 parts by weight of Sun Blue Flush, which is a mixture of 30 weight percent P.B. 15:3 copper phthalocyanine, and 70 weight percent Resapol HT prepared at Sun Chemicals by flushing to obtain a high quality pigment dispersion, and 1 percent of potassium tartrate (from Lancaster Chemical) were blended together and extruded in a ZSK-40 extruder. The extruded blend was jetted and classified to form a cyan toner with 92 percent by weight of the above resin, about 7 weight percent of 15:3 copper phthalocyanine and 1 percent of potassium tartrate, and wherein the toner particle size was about 6.5 microns as measured by a Layson Cell. The final cyan toner had a gel concentration of about 6 weight percent.

A developer was prepared by mixing 4 parts of the above prepared toner with 100 parts of a carrier of a Hoeganaes steel core coated with 100 weight percent of polymethylmethacrylate. The developer-was acclimated at 50 percent RH in an environmental chamber for 24 hours . After 90 minutes of paint shaking, the toner possessed a blow off tribo of −30 femtocoulombs per gram.

EXAMPLE XI 74.5 Parts by weight of the Resapol HT resin from Example I, 14 parts by weight of the 30 weight percent gel polyester from Example II, and 11 parts by weight of Sun Blue Flush, comprised of a mixture of 30 weight percent P.B. 15:3 copper phthalocyanine, and 70 weight percent Resapol HT prepared at Sun Chemicals by flushing to obtain a high quality pigment dispersion, and 3 percent potassium tartrate (obtained from Lancaster Chemical) were blended together and extruded in a ZSK-40 extruder. The extruded blend was jetted and classified to form a cyan toner with about 92 percent by weight of the above resin, about 5 weight percent of 15:3 copper phthalocyanine, and 3 percent potassium tartrate, and wherein the toner particle size (volume average diameter throughout) was about 6.5 microns as measured by a Layson Cell. The final cyan toner had a gel concentration of 5 weight percent.

A developer was prepared by mixing 4 parts of the above prepared toner with 100 parts of a carrier of a Hoeganaes steel core, 65 microns, coated with 100 weight percent of polymethylmethacrylate. The developer was acclimated at 50 percent RH in an environmental chamber for 24 hours . After 90 minutes of paint shaking, the toner possessed a blow off tribo of −29 femtocoulombs per gram.

EXAMPLE XII

A developer was prepared by mixing 4 parts of the toner from Example IVA with 100 parts of the carrier of Carrier Example I. The developer was acclimated at 50 percent RH in an environmental chamber for 24 hours . After 90 minutes of paint shaking, the toner possessed a blow off tribo of −43 femtocoulombs per gram.

EXAMPLE XIII

A developer was prepared by mixing 4 parts of the toner of Example IVB with 100 parts of the carrier of Carrier Example I. The developer was acclimated at 50 percent RH in an environmental chamber for 24 hours . After 90 minutes of paint shaking, the toner possessed a blow off tribo of −59 femtocoulombs per gram.

EXAMPLE XIV

A developer was prepared by mixing 4 parts of the toner of Example V with 100 parts of the carrier of Carrier Example I. The developer was acclimated at 50 percent RH in an environmental chamber for 24 hours . After 90 minutes of paint shaking, the toner possessed a blow off tribo of −53 femtocoulombs per gram.

EXAMPLE XV

A developer was prepared by mixing 4. parts of the toner of Example VI with 100 parts of the carrier of Carrier Example I. The developer was acclimated at 50 percent RH in an environmental chamber for 24 hours . After 90 minutes of paint shaking, the toner possessed a blow off tribo of −61 femtocoulombs per gram.

EXAMPLE XVI

A developer was prepared by mixing 4 parts of the toner of Example VII with 100 parts of the carrier of Carrier Example I. The developer was acclimated at 50 percent RH in an environmental chamber for 24 hours . After 90 minutes of paint shaking, the toner possessed a blow off tribo of −54 femtocoulombs per gram.

EXAMPLE XVII

A developer was prepared by mixing 4 parts of the toner of Example IX with 100 parts of the carrier of Carrier Example I. The developer was acclimated at 50 percent RH in an environmental chamber for 24 hours. After 90 minutes of paint shaking, the toner possessed a blow off tribo of -56 femtocoulombs per gram.

EXAMPLE XVIII

A thirty (30) gram sample of the control toner of Example III with no charge enhancing additive was added to a 9 ounce jar with 150 grams of stainless steel beads. To this mixture was then added 3.5 weight percent of NA50HS (30 nanometers of primary particle size fumed silica available from Nippon Aerosil Corporation), 2.5 weight percent of SMT5103 (40 nanometers of primary particle size titanium dioxide coated with decylsilane generated from decyltrimethoxysilane obtained from Tayca Corporation), and 0.3 weight percent zinc stearate L obtained from Synthetic Products Company. After mixing on a roll mill for 30 minutes, the steel beads were removed from the jar.

A developer was prepared by mixing 4 parts of the above prepared blended toner with 100 parts of the carrier of Carrier Example II. This developer was then acclimated at 50 percent RH in an environmental chamber for 24 hours . After 90 minutes of paint shaking, the toner possessed a blow off tribo of −38 femtocoulombs per gram. Thereafter, the charge distribution of the resulting developer was measured as a function of the mixing time, and it was determined by a charge spectrograph that the admixing behavior resulted in charge through of the incoming toner at 15 seconds of mixing time. The added toner continued to charge through throughout 2 minutes of mixing time.

EXAMPLE XIX

A 30 gram sample of the toner of Example V was added to a 9 ounce jar with 150 grams of stainless steel beads. To this was added 3.5 weight percent NA50HS (30 nanometers of primary particle size fumed silica available from Nippon Aerosil Corporation), 2.5 weight percent SMT5103 (40 nanometers of primary particle size titanium dioxide coated with decylsilane generated from decyltrimethoxysilane and obtained from Tayca Corporation), and 0.3 weight percent potassium stearate L obtained from Synthetic Products Company. After mixing on a roll mill for 30 minutes, the steel carrier beads were removed from the jar.

A developer was prepared by mixing 4 parts of the above prepared blended toner with 100 parts of the carrier of Carrier Example II. The developer was acclimated at 50 percent RH in an environmental chamber for 24 hours. After 90 minutes of paint shaking, this toner possessed a blow off tribo of −43 femtocoulombs per gram. Thereafter, the charge distribution of the resulting developer was measured as a function of the mixing time, and it was determined by a charge spectrograph that the admixing behavior resulted in fast admix of an incoming toner at 15 seconds of mixing time. The added toner did not show any peak separation between the incumbent and incoming toner peaks, and no wrong sign toner was apparent until 2 minutes. This indicates that incorporating the potassium stearate into the toner improves the admix behavior of the above blended toner.

Other modifications of the present invention may occur to those skilled in the art subsequent to a review of the present application, and these modifications, including equivalents thereof, are intended to be included within the scope of the present invention.

What is claimed is:

1. A toner comprised of resin, colorant, and a potassium sorbate, or a potassium tartrate charge enhancing additive.

2. A toner composition comprised of resin particles, colorant particles, and charge additive of a potassium sorbate, a potassium tartrate, or mixtures thereof.

3. A toner in accordance with claim 1 wherein said charge additive is potassium sorbate.

4. A toner in accordance with claim 1 wherein said charge additive is potassium tartrate.

5. A toner composition in accordance with claim 2 wherein the charge additive mixture is comprised of from about 1 to about 99 weight percent of potassium sorbate, and from about 1 to about 99 weight percent of potassium tartrate, and wherein the total thereof is about 100 percent.

6. A toner composition in accordance with claim 2 further containing a second charge enhancing additive selected from the group consisting of distearyl methyl hydrogen ammonium bisulfate, didodecyl methyl ammonium hydrogen bisulfate, dihexadecyl methyl ammonium hydrogen bisulfate, distearyl ethyl ammonium hydrogen bisulfate, and bis(distearyl methyl hydrogen ammonium) sulfate, and wherein said second charge enhancing additive is present in an optional amount of from about 0.05 to about 3 weight percent.

7. A toner composition in accordance with claim 2 further containing a second charge enhancing additive selected from the group consisting of distearyl dimethyl ammonium methyl sulfonate, distearyl dimethyl ammonium trifluoromethyl sulfonate, didodecyl dimethyl ammonium hydrogen methyl sulfonate, dihexadecyl methyl ammonium hydrogen methyl sulfonate, didodecyl trifluoromethyl ammonium hydrogen methyl sulfonate, dihexadecyl methyl ammonium hydrogen trifluoromethyl sulfonate, distearyl diethyl ammonium ethyl sulfonate, and trifluoromethyl ammonium hydrogen methyl sulfonate.

8. A toner in accordance with claim 1 wherein the charge additive is present in an amount of from about 0.05 to about 5 weight percent.

9. A toner in accordance with claim 1 wherein the charge additive is present in an amount of from about 0.1 to about 3 weight percent.

10. A toner in accordance with claim 1 wherein the charge additive is incorporated into the toner, or wherein the charge additive is present on the surface of the toner composition.

11. A toner in accordance with claim 10 wherein the charge additive is contained on colloidal silica particles.

12. A toner in accordance with claim 1 with an admix time of from less than about or equal to about 15 seconds.

13. A toner in accordance with claim 1 with an admix time of from about 1 to about 14 seconds, and with a triboelectric charge of from about 40 to about 60 microcoulombs per gram.

14. A toner in accordance with claim 1 wherein the resin is comprised of styrene polymers, or polyesters.

15. A toner in accordance with claim 1 wherein the resin is comprised of styrene acrylates, styrene methacrylates, or styrene butadienes.

16. A toner in accordance with claim 1 containing a wax component with a weight average molecular weight of from about 1,000 to about 10,000.

17. A toner in accordance with claim 16 wherein the wax component is selected from the group consisting of polyethylene, polypropylene, and mixtures thereof.

18. A toner in accordance with claim 1 further containing as external additives metal salts of a fatty acid, colloidal silicas, or mixtures thereof.

19. A toner in accordance with claim 1 wherein the colorant is carbon black, magnetite, or mixtures thereof; cyan, magenta, yellow, red, blue, green, black, brown, or mixtures thereof.

20. A toner in accordance with claim 1 wherein the charge additive is present in an amount of from about 0.05 to about 1 weight percent, or is present in an amount of from about 0.1 to about 2 weight percent.

21. A toner in accordance with claim 1 wherein the colorant is carbon black.

22. A developer composition comprised of a toner comprised of resin, colorant, and a potassium sorbate, or a potassium tartrate charge enhancing additive, and carrier particles.

23. A developer composition in accordance with claim 22 wherein the carrier particles are comprised of ferrites, steel, or an iron powder.

24. A developer composition in accordance with claim 22 wherein the carrier particles are comprised of a core with a polymer coating thereover.

25. A developer composition in accordance with claim 24 wherein the coating is comprised of a methyl terpolymer, a polyvinylidene fluoride, a polymethyl methacrylate, or a mixture of polymers not in close proximity in the triboelectric series.

26. A single component toner composition comprised of resin particles, magnetite components, and as a charge additive potassium sorbate, or potassium tartrate.

27. A method of imaging which comprises formulating an electrostatic latent image on a photoreceptor, affecting development thereof with the toner composition of claim 1, and thereafter transferring the developed image to a substrate.

28. A xerographic apparatus comprising a charging component, a photoreceptor component, a development component, a transfer component, and an optional cleaning component; and wherein said developer compound contains the toner of claim 1.

29. A developer in accordance with claim 22 wherein said charge enhancing additive is a potassium sorbate.

30. A developer in accordance with claim 22 wherein said charge enhancing additive is a potassium tartrate.

31. A toner comprised of resin colorant and a potassium sorbate as a charge enhancing additive.

32. A toner comprised of resin colorant and as a charge enhancing additive a potassium tartrate.

* * * * *